US009834997B2

(12) United States Patent
Nicholson

(10) Patent No.: US 9,834,997 B2
(45) Date of Patent: Dec. 5, 2017

(54) TOOL CONNECTION RELEASE SYSTEM

(71) Applicant: ONESUBSEA IP UK LIMITED, London (GB)

(72) Inventor: Joseph Allan Nicholson, Broughton in Furness (GB)

(73) Assignee: OneSubsea IP UK Limited, London (GB)

( * ) Notice: Subject to any disclaimer, the term of this patent is extended or adjusted under 35 U.S.C. 154(b) by 355 days.

(21) Appl. No.: 14/630,338

(22) Filed: Feb. 24, 2015

(65) Prior Publication Data

US 2016/0245024 A1 Aug. 25, 2016

(51) Int. Cl.
*E21B 17/06* (2006.01)

(52) U.S. Cl.
CPC ..... *E21B 17/06* (2013.01)

(58) Field of Classification Search
CPC ..... E21B 17/06; E21B 17/02023
See application file for complete search history.

(56) References Cited

U.S. PATENT DOCUMENTS 3,876,003 A * 4/1975 Kisling, III ..... E21B 33/1246 166/187
4,984,632 A * 1/1991 Sampa ..... E21B 23/04 166/237
5,018,582 A * 5/1991 Baker ..... E21B 17/06 166/208
5,579,840 A * 12/1996 Saurer ..... E21B 23/06 166/123
5,984,006 A * 11/1999 Read ..... E21B 17/028 166/242.2
6,196,325 B1 3/2001 Connell et al.
2003/0188860 A1* 10/2003 Zimmerman ..... E21B 23/06 166/181
2005/0000693 A1* 1/2005 Ravensbergen ..... E21B 17/06 166/301
2005/0211446 A1* 9/2005 Ricalton ..... E21B 23/06 166/382
2006/0048940 A1* 3/2006 Hromas ..... E21B 17/06 166/297

(Continued)

FOREIGN PATENT DOCUMENTS

GB 2294714 A * 5/1996 ..... E21B 17/023
WO 01/16456 A1 3/2001
WO WO 2014193420 A1 * 12/2014 ..... E21B 17/06

*Primary Examiner* — Jennifer H Gay
(74) *Attorney, Agent, or Firm* — Conley Rose, P.C.

(57) ABSTRACT

A connection release system for the disconnection of various connections, such as electrical, hydraulic, optical, and/or multi-connector, to a service tool in a high pressure environment. An embodiment of the connection release system includes a first and second housing portion with a piston disposed partially within both the first and second housing portions, the piston having a plurality of threads at an exterior portion of a second end. The system further includes a plurality of fluid chambers disposed in the first housing portion, the fluid chambers are filled with fluid to pressure-balance the piston such that the addition of a pressurized fluid to the pressure-balanced piston causes the piston to move, the exterior threaded portion of the piston to disengage an interior threaded portion within the housing second portion, and allow the first housing portion to separate from the second housing portion.

21 Claims, 11 Drawing Sheets

(56) References Cited

U.S. PATENT DOCUMENTS

| | | | | |
|---|---|---|---|---|
| 2006/0113083 | A1* | 6/2006 | Connell | E21B 17/06 166/377 |
| 2010/0319930 | A1* | 12/2010 | Evans | E21B 17/023 166/377 |
| 2012/0090849 | A1* | 4/2012 | Stanford | E21B 17/06 166/323 |
| 2012/0152521 | A1* | 6/2012 | Akkerman | E21B 17/06 166/85.1 |
| 2013/0312996 | A1* | 11/2013 | Nicholson | H02G 9/065 174/50.52 |
| 2014/0076537 | A1* | 3/2014 | Doane | E21B 23/04 166/156 |
| 2015/0252628 | A1* | 9/2015 | Cochran | E21B 17/07 166/387 |
| 2015/0376958 | A1* | 12/2015 | Ringgenberg | E21B 34/063 166/373 |
| 2016/0245024 | A1* | 8/2016 | Nicholson | E21B 17/06 |

* cited by examiner

TOOL CONNECTION RELEASE SYSTEM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

This disclosure relates to a tool connection release system for one or more pieces of equipment that may be positioned in a borehole, a well, subsea, or other environment that allows the disconnection of various connections (e.g., electrical, hydraulic, optical, and/or multi-connector) in a high pressure environment. More particularly, this disclosure relates to systems for hydraulically disconnecting a tool independent of the environmental pressure. The systems may also include a secondary release mechanism.

Traditionally, if a tool package suspended from an armored or coiled tubing umbilical is to be recovered, the tool is released to allow heavy lift capable equipment using a retrieval string to be deployed to recover the tool. For hydraulic release of the tool, a piston would have to overcome the external pressure in the well, which can be as high as 24,000 psi or more. This high pressure then may lead the line pressure to be higher than the external pressure to allow actuation of the piston. Shear pins have also been conventionally used as a disconnection means, but shear pins are delicate and typically highly loaded, and can suffer fracture due to fatigue or localized corrosion from stress corrosion cracking.

BRIEF SUMMARY OF THE DISCLOSURE

In an embodiment, a tool connection release system includes a housing having a first portion and a second portion, a piston disposed at least partially within the housing first portion and at least partially within the housing second portion, a first fluid chamber including a first pressurized fluid acting against the piston, a fluid source coupled to the first fluid chamber, and a second fluid chamber including a second pressurized fluid acting against the piston to oppose the first pressurized fluid and pressure-balance the piston. Moreover, addition of a fluid from the fluid source to the pressure-balanced piston causes the piston to move and the first housing portion to separate from the second housing portion.

In an embodiment, a tool connection release system includes a housing having a first portion and a second portion, the first portion being coupled to a cable, a piston having a first end axially disposed at least partially within the housing first portion, and a plurality of threads at a second end. In addition, the release system includes a release nut disposed within the housing second portion and having a plurality of threads at an interior portion of a first end, a recess at an exterior portion of the first end, a second end, and a plurality of circumferentially disposed slots that pass through the plurality of threads and the recess in the first end, the second end being attached to a portion of the housing second end. Further, the threaded exterior portion of the piston is configured to releasably engage the threaded interior portion of the release nut and the plurality of circumferentially disposed slots is configured to allow the release nut first end to move radially outward and disengage the threaded exterior portion of the piston from the threaded interior portion of the release nut such that the piston and the housing first portion can be separated from the release nut and the housing second portion.

In an embodiment, a tool connection release system includes a plug connector having a first end and a second end, the first end coupled to a cable, and an outer portion of the second end having at least one axial protrusion. The release system further includes an actuation cylinder housing having a first end coupled to the plug connector, a second end, and a plurality of circumferentially spaced galleries, and a piston having a first end, a second end, and a plurality of threads at an exterior portion of the second end, the piston being axially disposed at least partially within the activation cylinder housing and forming a first cavity therein. In addition, the release system includes a piston cap that is disposed around the piston and forms a second cavity therein, threadably engages the second end of the actuation cylinder, and is configured to retain the first end of the piston within the actuation cylinder, and a motor head having a first end and a second end, an inner portion of the first end having at least one axial recess configured to engage the protrusion on the outer portion of the plug connector second end. Moreover, the release system includes a release nut having a plurality of threads at an interior portion of a first end, a recess at an exterior portion of the first end, a second end, and a biasing member disposed in the recess, and a protection sleeve disposed about the release nut and a portion of the piston cap, the sleeve forming a third cavity with the release nut. Furthermore, the piston is configured to axially slide around an outer portion of the motor head and the plurality of threads on the exterior portion of the piston second end is configured to releasably engage the threads on the interior portion of the release nut first end upon addition of a pressurized fluid.

Embodiments described herein comprise a combination of features and advantages intended to address various shortcomings associated with certain prior devices, systems, and methods. The foregoing has outlined rather broadly the features and technical advantages of the disclosure such that the detailed description of the disclosure that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the disclosure. It should also be realized by those skilled in the art that such equivalent constructions do not depart from the spirit and scope of the disclosure as set forth in the appended claims.

BRIEF DESCRIPTION OF THE DRAWINGS

For a detailed description of the various embodiments, reference will now be made to the accompanying drawings in which.

DETAILED DESCRIPTION

Figure 1:
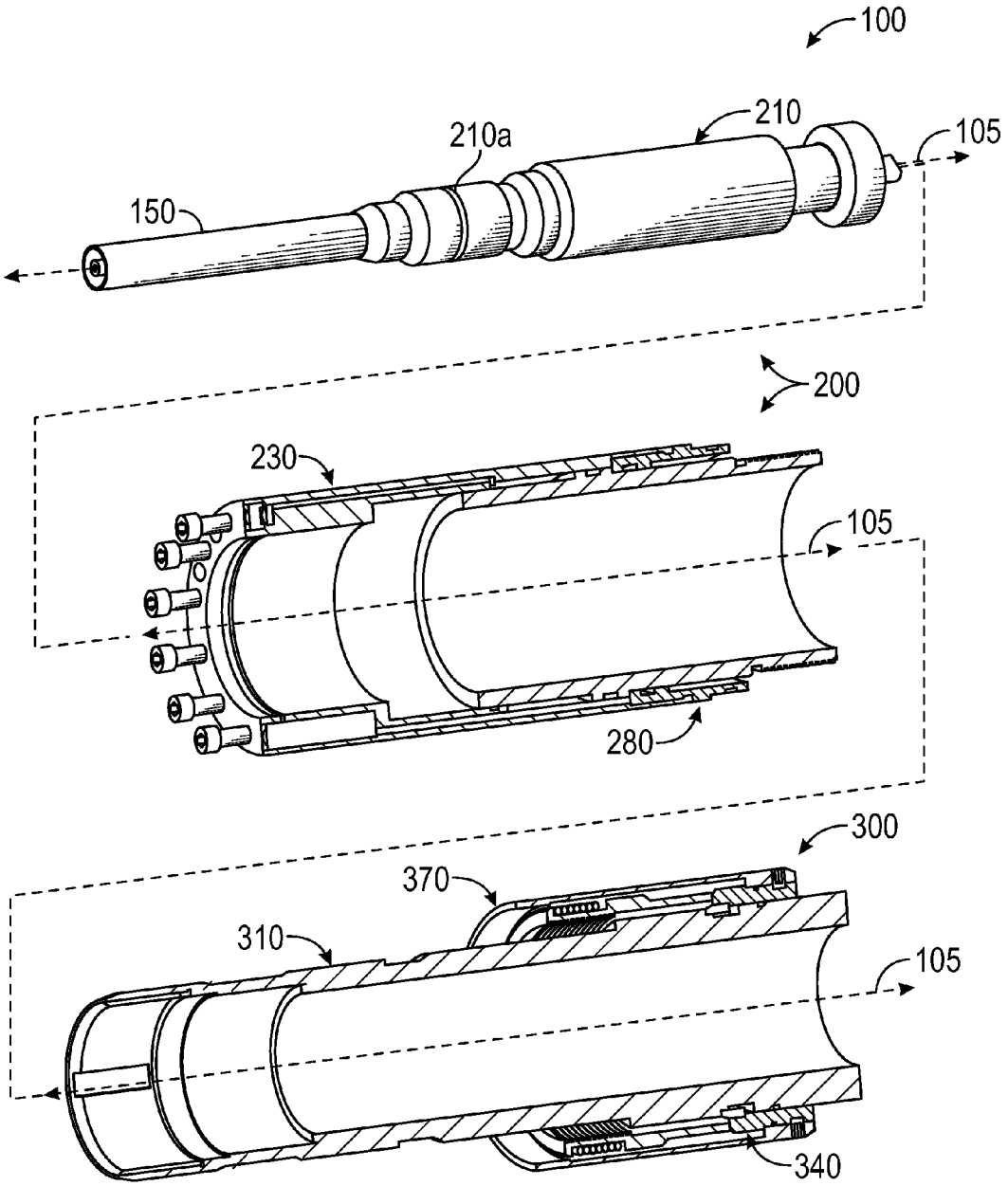
FIG. 1 is a schematic exploded and partial cross-sectional view of a tool release system with a plug connector and motor head in accordance with the principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosures, including the claims, is limited to that embodiment.

Certain terms are used throughout the following description and claim to refer to particular system components. This document does not intend to distinguish between components that differ in name but not function. Moreover, the drawing figures are not necessarily to scale. Certain features of the disclosure may be shown exaggerated in scale or in somewhat schematic form, and some details of conventional elements may not be shown in the interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Still further, reference to "up" or "down" may be made for purposes of description with "up," "upper," "upward," or "above" meaning generally toward or closer to the surface of the earth, and with "down," "lower," "downward," or "below" meaning generally away or further from the surface of the earth.

The present disclosure relates to a hydraulic tool connection release system that functions independent of environmental pressure and provides a consistent release pressure. The system may also include a secondary release means.

Referring now to FIG. 1, the tool connection release system or release system 100 allows the disconnection of various connections (e.g., electrical, hydraulic, optical, and/or multi-connector) to a service tool in a high pressure environment. The release system 100 comprises a central axis 105 and a first or upper end 200 that releasably connects to a second or lower end 300. The upper end 200 includes a plug connector 210 configured to connect to a cable 150, shown in the top portion of FIG. 1. The remaining components of the upper end 200, described in further detail below, are shown in the middle portion of FIG. 1; and the components of the lower end 300 are shown in the bottom portion of FIG. 1.

Figure 2:
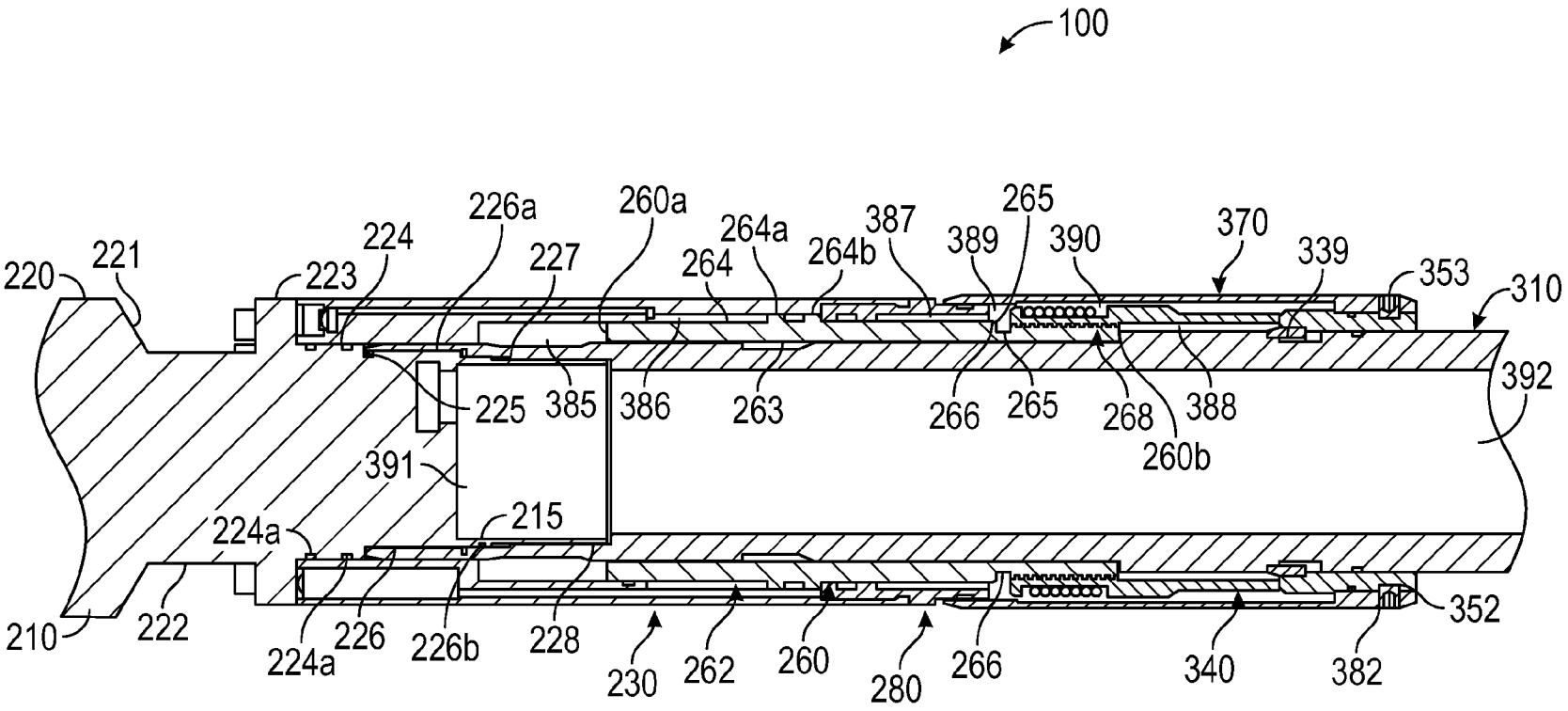
FIG. 2 is a cross-sectional side view of the release system of FIG. 1.

Referring now to FIGS. 1 and 2, the plug connector 210 of the first or upper end 200 of the release system 100 is coupled to an actuation cylinder housing 230, a piston 260 disposed in a portion of the cylinder housing 230, and a piston cap 280 configured to engage the cylinder housing 230 and retain at least a portion of the piston 260 within the cylinder housing 230. The plug connector 210 of the upper end 200 is configured to connect to a cable 150 that extends upward to the surface. The cable may be connected to the plug connector 210 by any manner known in the art. See, for example, U.S. Patent Application Publication No. 2013/0312996, which is incorporated in its entirety by reference herein. The cable may be any type of cable standard in the art including, but not limited to, an armored or coiled tubing umbilical, which may contain high voltage (HV) power feed cables for pumps or heaters as well as instrumentation and at least one hydraulic line for actuation of the release system.

Referring now to FIGS. 1, 2, 4, and 5, the plug connector 210 comprises a first annular end 210*a* opposite a second annular end 210*b* and a generally cylindrical inner surface 215. For clarity, the various electrical, hydraulic, and optical connections are removed, but would generally be located within the cylindrical inner surface 215.

Figure 4:
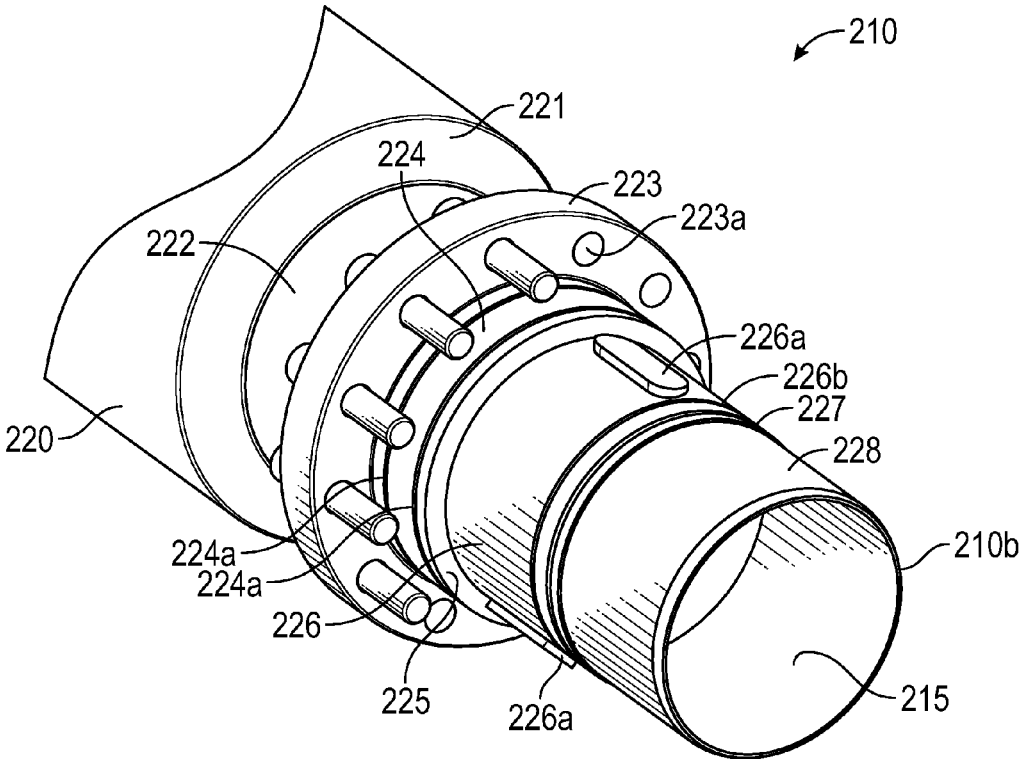
FIG. 4 is an isometric view of the plug connector of the release system of FIG. 2.
Figure 5:
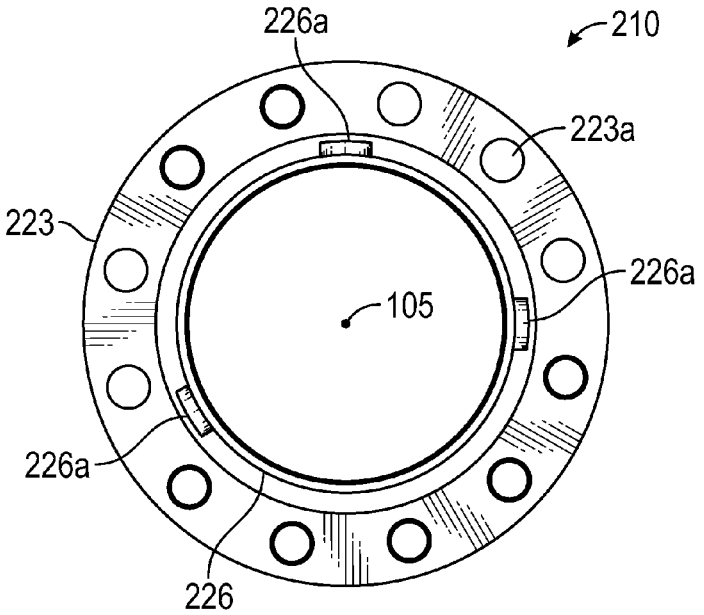
FIG. 5 is a front view of the plug connector of FIG. 4.

Referring now to FIGS. 4 and 5, the plug connector 210 further comprises a first cylindrical outer surface 220 extending axially from the first end 210*a* (FIG. 1) to an outer angular shoulder 221 that extends axially toward plug connector second end 210*b* and radially inward to a second cylindrical outer surface 222. Second cylindrical outer surface 222 extends axially to a flange 223 having a plurality of circumferentially spaced through holes 223*a*. A third cylindrical outer surface 224 extends axially from the flange 223 to a first downward-facing shoulder 225. The third cylindrical outer surface 224 includes two grooves 224*a*, each configured to receive a seal. The seal may be any type of seal known in the art including, but not limited to an O-ring, metal C-seals, and labyrinth seals with back-up rings. A fourth cylindrical outer surface 226 extends axially between the first downward-facing shoulder 225 and a second downward-facing shoulder 227. The fourth cylindrical outer surface 226 has a plurality of protruding keys 226*a* that extend axially between the first downward-facing shoulder 225 and a groove 226*b* disposed on the fourth cylindrical outer surface 226 proximate a fifth cylindrical outer surface 228. In the present embodiment, the fourth cylindrical surface 226 has three keys 226*a*; in other embodiments, surface 226 may have as few as one key or four or more keys.

Referring now to FIGS. 2, 3, 6, and 7, the actuation cylinder housing 230 is tubular and has a first end 230*a* opposite a second end 230*b*, a cylindrical outer surface 232, and a generally cylindrical inner surface 233. The inner surface 233 comprises a first cylindrical surface 234 that extends axially from the housing first end 230*a* to a first downward-facing shoulder 235. A second inner cylindrical surface 236 extends axially from the first shoulder 235 to a second downward-facing shoulder 237. The diameter of the first cylindrical surface 234 is smaller than the diameter of the second cylindrical surface 236. The second cylindrical surface 236 includes a groove 236*a* disposed proximate the second downward-facing shoulder 237. A third cylindrical surface 238 extends axially from the second shoulder 237 to a graduated downward-facing shoulder 239, and a threaded cylindrical surface 240 extends from the shoulder 239 to the second end 230*b*.

Figure 6:
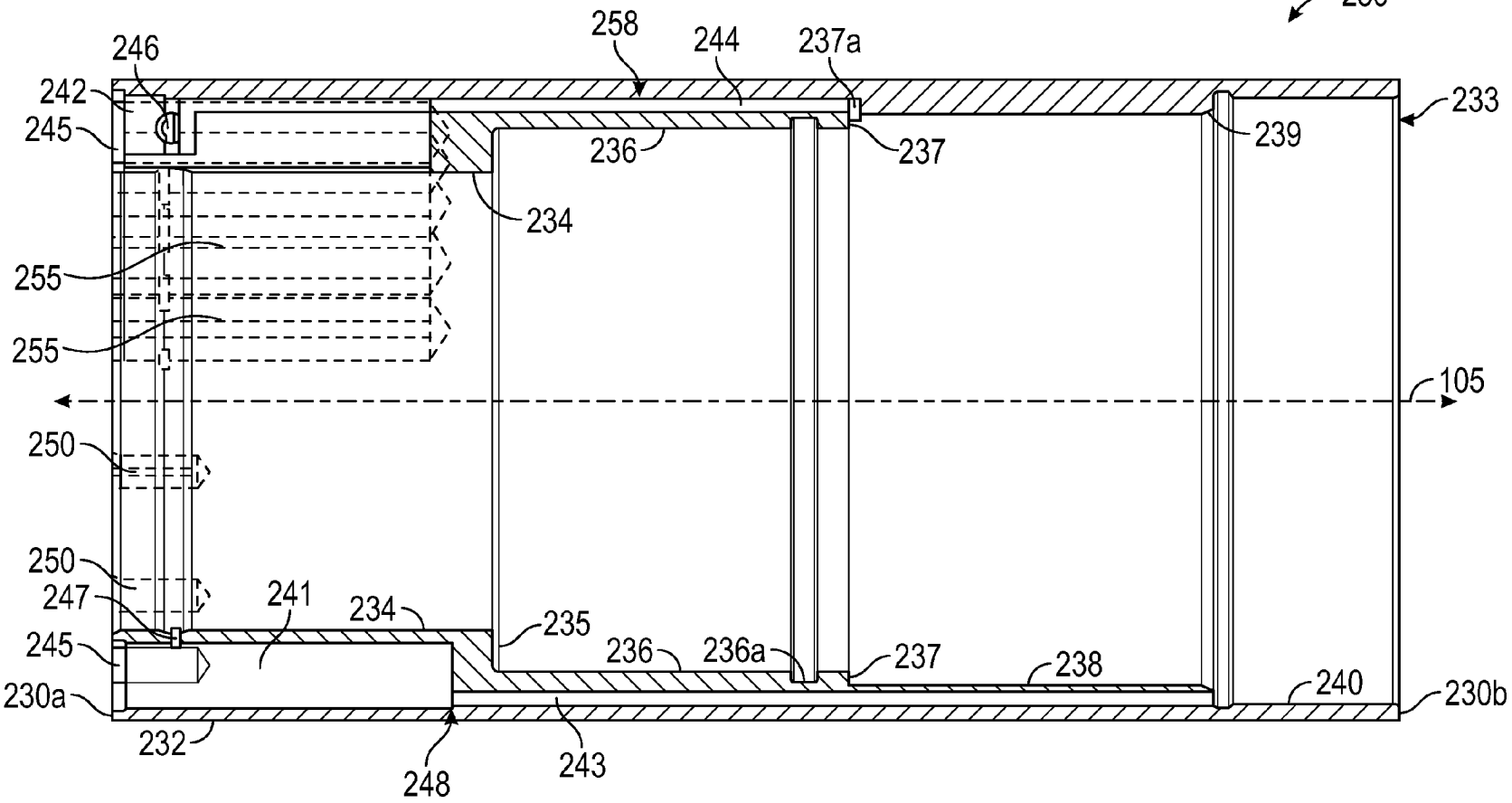
FIG. 6 is a cross-sectional side view of the actuation cylinder housing of the release system of FIG. 2.
Figure 7:
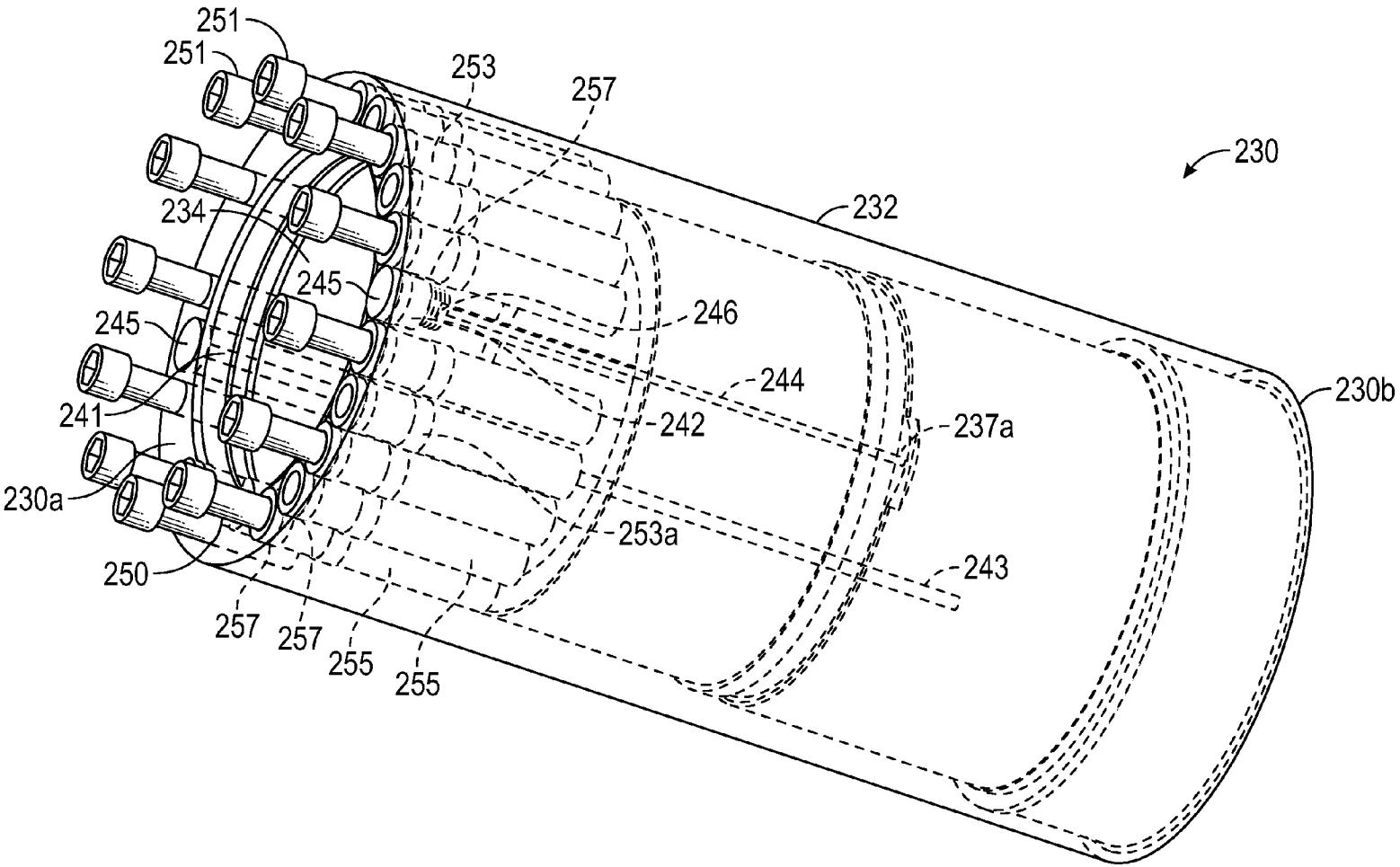
FIG. 7 is an isometric view of the actuation cylinder housing of FIG. 6.

Referring to FIGS. 6 and 7, the housing 230 further comprises a first cylindrical chamber 241 that extends between the housing first end 230*a* and a first elongate channel 243. The first cylindrical chamber 241 has a cover 245 covering the opening of the chamber at housing first end 230*a*, and an inlet port 247 radially disposed proximate the housing first end 230*a* and in fluid communication with a control line or hydraulic fluid source (not shown). The first cylindrical chamber 241 and the first elongate channel 243 together form a first fluid chamber 248. The cover 245 may be secured to the housing first end 230*a* in any manner known in the art including, but not limited to, welded, threaded, or any other suitable mechanical fastener that is configured to seal with housing 230. The first elongate channel 243 extends axially from the first chamber 241 through to the graduated downward-facing shoulder 239. The first chamber 241 and the first elongate channel 243 are in fluid communication, and the first elongate channel 243 is in fluid communication with the housing inner surface 233 at shoulder 239.

The housing 230 also comprises a second cylindrical chamber 242 that extends between the housing first end 230*a* and a second elongate channel 244. The second cylindrical chamber 242, like the first cylindrical chamber 241, has a cover 245 covering the opening of the chamber at housing first end 230*a*. The second cylindrical chamber 242 also contains a sealed opening 246 having an outer diameter substantially similar to the inner diameter of the second cylindrical chamber 242 to form a seal. The second elongate channel 244 extends axially from the second chamber 242 to an opening 237*a* disposed at the second shoulder 237. The second chamber 242 and the second elongate channel 244 are in fluid communication after the sealed opening 246 is opened. The sealed opening 246 may be any type of sealed opening or barrier capable of opening under a predetermined pressure known in the art including, but not limited to, a burst disc. The sealed opening 246 may also be referred to as a burst disc 246 that opens or ruptures at a predetermined pressure. Until the burst disc 246 bursts, the second cylindrical chamber 242 is at 1 atm and the second elongate channel 244 is in fluid communication with the housing third cylindrical surface 238 via the opening 237*a* at shoulder 237. The second elongate channel 244 and the opening 237*a* form a second fluid chamber 258.

Figure 8:
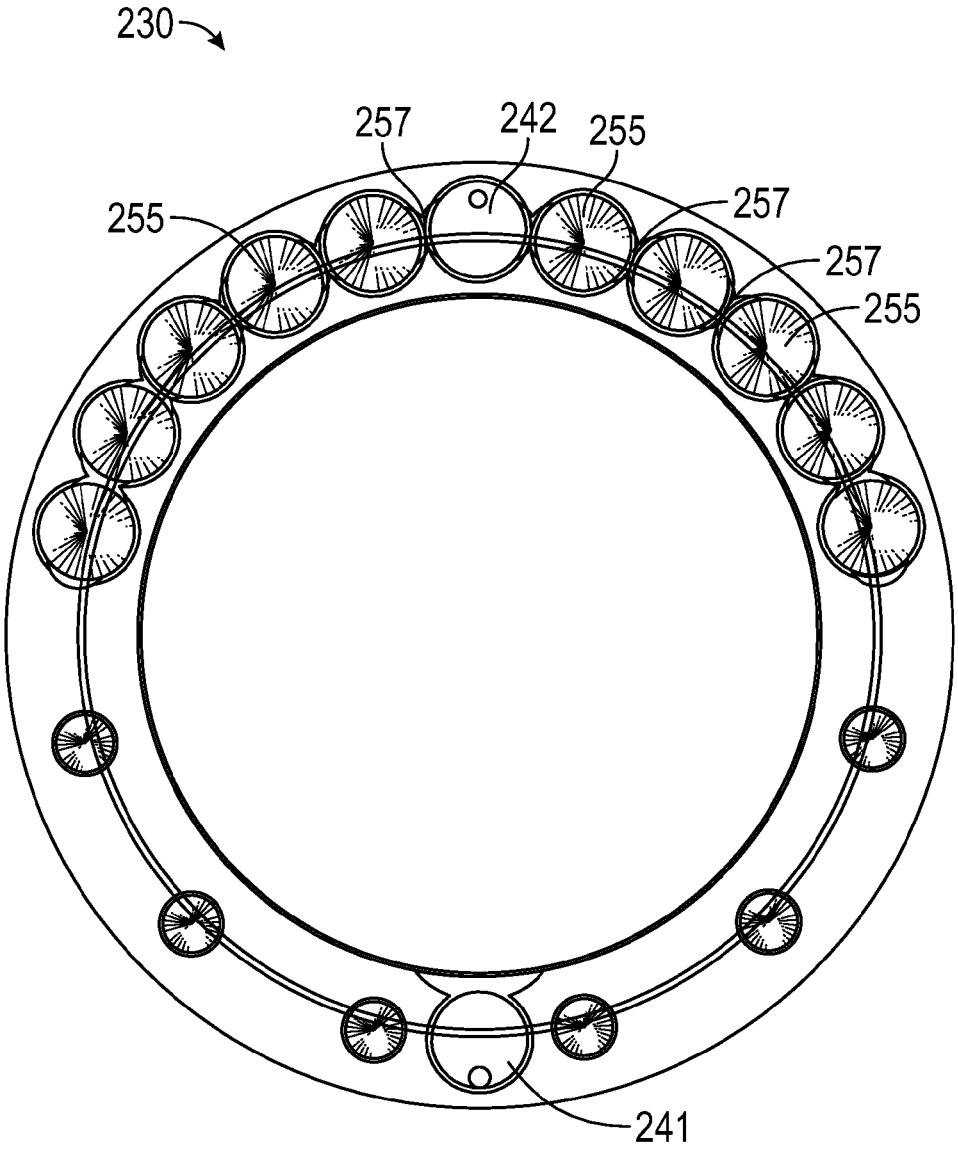
FIG. 8 is a cross-sectional front view of the actuation cylinder housing of FIG. 6.

Referring now to FIGS. 7 and 8, the housing first end 230*a* further includes a plurality of threaded bores 250 spaced circumferentially about the central axis 105 between the outer surface 232 and the first cylindrical surface 234. The threaded bores 250 are configured to accept threaded fasteners or bolts 251. However, a portion of the bolts 251 threadably engage a plug 253, each plug being coupled to and disposed in a cylindrical overflow cavity 255 disposed circumferentially between the outer surface 232 and the first cylindrical surface 234 and extending from the first end 230*a* toward first downward-facing shoulder 235. Each plug 253 may be coupled to each cavity 255 in any manner known in the art including, but not limited to, welded, threaded, or any other suitable mechanical fastener configured to seal with housing 230. In the present embodiment, there are ten cavities 255 disposed about the second cylindrical chamber 242 (five on either side) with no cavities 255 disposed about the first cylindrical chamber 241 for the remaining bolts or fasteners, as shown in FIGS. 6 and 7. Though, in the embodiment as shown, plugs 253 are disposed in each cavity 255, a bolt 251 need not be threadably engaged in each plug 253.

Referring still to FIGS. 7 and 8, furthermore, each cavity 255 is in fluid communication with one another and with the second chamber 242 through connecting galleries 257 disposed between and connecting each adjacent cavity 255 and chamber 242 proximate upper end 230*a* of the housing 230. Each plug 253 includes axial channels 253*a* that allow fluid communication between the portion of the cavity 255 surrounding the plug 253 and the portion of the cavity below the plug 253. Thus, each cavity 255 is in fluid communication with the other cavities 255, the second chamber 242, second elongate channel 244 once the burst disc 246 is breached, and the opening 237*a* at shoulder 237

Figure 9:
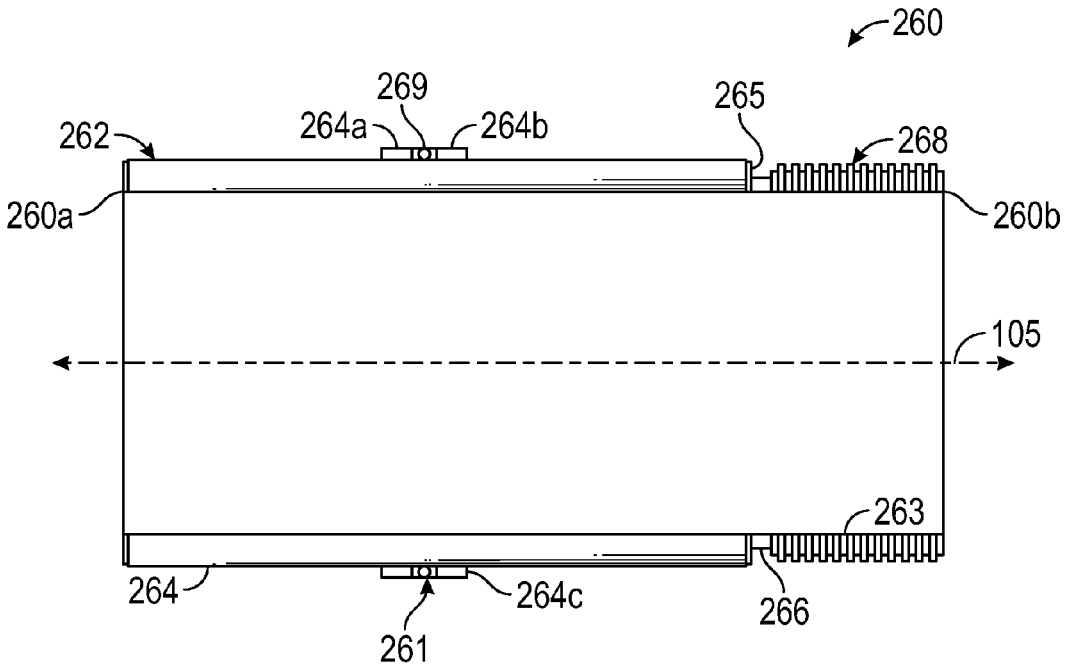
FIG. 9 is a cross-sectional side view of the piston of the release system of FIG. 2.

Referring now to FIG. 9, the piston 260 is tubular and has a first or upper end 260*a* opposite a second or lower end 260*b*, a generally cylindrical outer surface 262, and a cylindrical inner surface 263. The outer surface 262 comprises a first cylindrical surface 264 that extends axially from the housing first end 260*a* to a downward-facing shoulder 265. A second cylindrical surface 266 extends axially from the shoulder 265 to a threaded portion 268, and the threaded portion 268 extends from the second cylindrical surface 266 to the piston second side 260*b*. The first cylindrical surface 264 includes a first and a second annular protrusion or ring 264*a*, 264*b*, respectively, spaced apart to form an annular groove 261 therebetween and disposed approximately midway between the piston first end 260*a* and the shoulder 265. A sealing element 269 may be disposed in the annular groove 261, and may be any type of seal known in the art including, but not limited to, an O-seal, T-seal with back up rings, polymeric spring energized lip seals, metallic lip seals, and C-rings. The diameter of the first cylindrical surface 264 is greater than the diameter of the second cylindrical surface 266.

Figure 3:
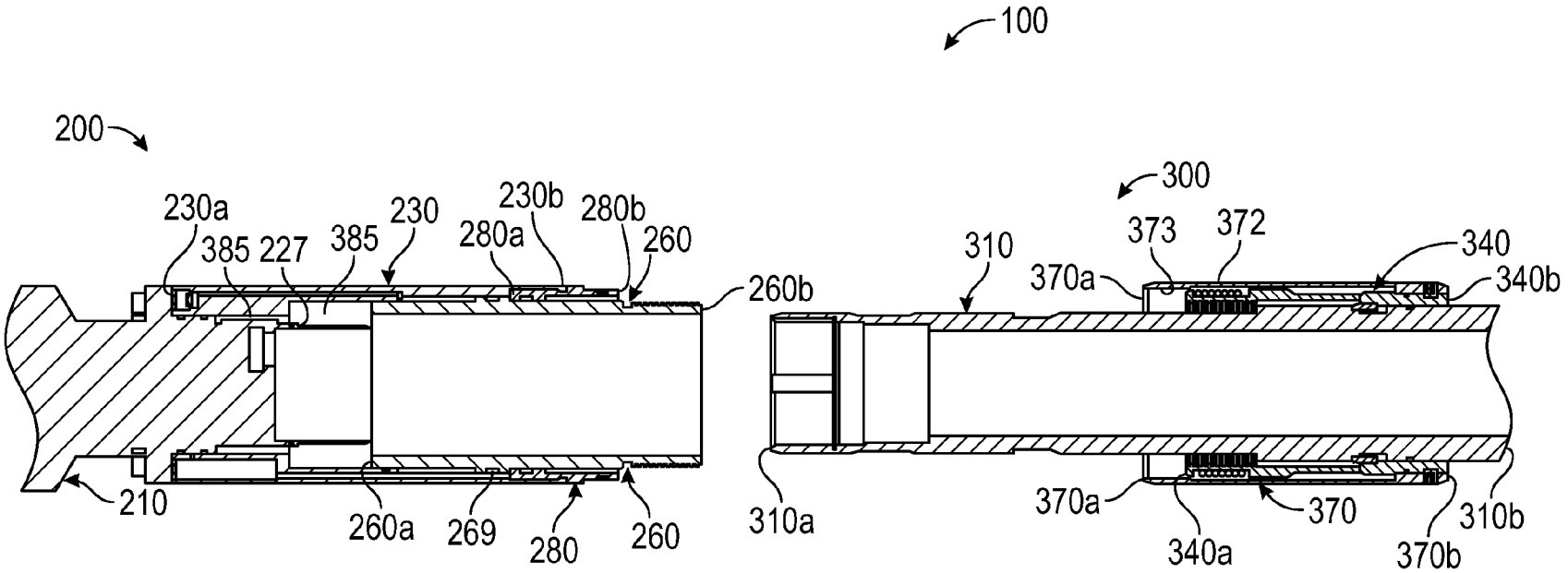
FIG. 3 is a cross-sectional side view of the release system of FIG. 2 in a disconnected state.
Figure 10:
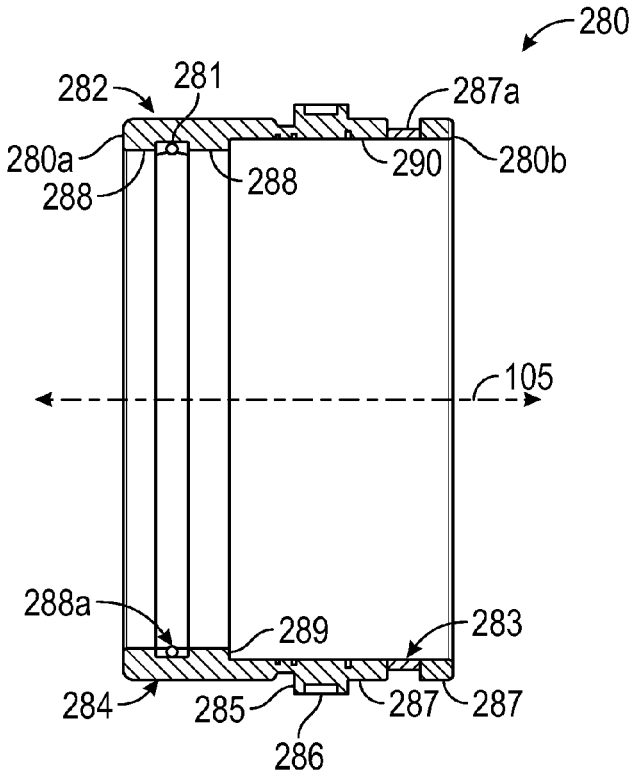
FIG. 10 is a cross-sectional side view of the piston cap of the release system of FIG. 2.

Referring now to FIGS. 3 and 10, the piston cap 280 is tubular and has a first or upper end 280*a* opposite a second or lower end 280*b*, a generally cylindrical outer surface 282, and a generally cylindrical inner surface 283. The outer surface 282 comprises a threaded portion 284 that extends axially from the piston cap first end 280*a* to an upward-facing shoulder 285. An annular protrusion or ring 286 extends axially from the upward-facing shoulder 285 to a cylindrical surface 287, and the cylindrical surface 287 extends from the protrusion 286 to the piston cap second end 260*b*. The cylindrical surface 287 includes an annular indention or groove 287*a* spaced approximately midway between the protrusion 286 and the piston cap second end 280*b*. The indention 287*a* is configured to receive a seal. The seal may be any type of seal known in the art including, but not limited to an O-ring, O-seal, T-seal with back up rings, polymeric spring energized lip seals, metallic lip seals, and C-rings.

The piston cap 280 further comprises a first cylindrical surface 288 that extends between the piston cap first end 280*a* and a downward-facing shoulder 289. The first cylindrical surface 288 has an annular groove or indentation 288*a* disposed approximately midway between the piston cap first end 280*a* and the shoulder 289. The indention 288*a* is configured to house a seal. The seal may be any type of seal known in the art including, but not limited to an O-ring, O-seal, T-seal with back up rings, polymeric spring energized lip seals, metallic lip seals, and C-rings.

Referring now to FIGS. 2 and 3, the second or lower end 300 of the release system 100 comprises a motor head 310, a release nut 340 disposed about a portion of the motor head 310, and a protection sleeve 370 disposed about and coupled to the release nut 340. The motor head 310 of the lower end 300 is configured to connect to a service tool (not shown). The service tool may be any type of service tool standard in the art including, but not limited to, an electric submersible pump.

Figure 11:
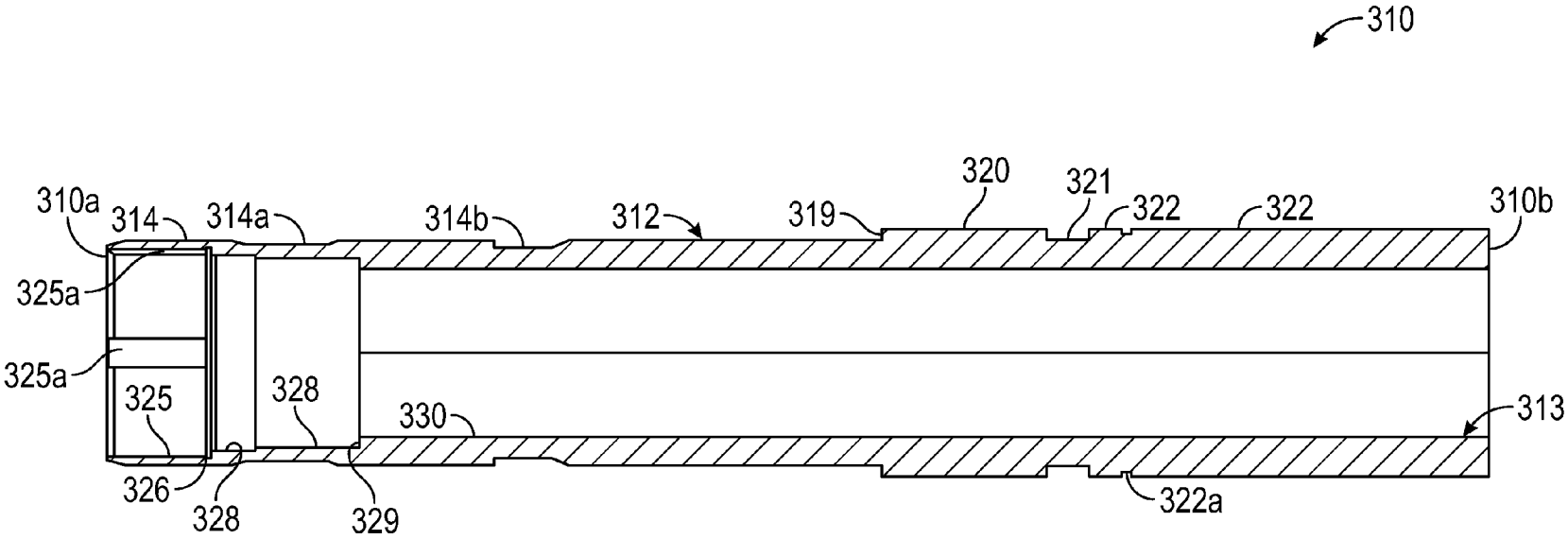
FIG. 11 is a cross-sectional side view of the motor head of the release system of FIG. 2.

Referring now to FIGS. 2, 3, and 11, the motor head 310 comprises a first annular end 310*a* opposite a second annular end 310*b*, a generally cylindrical outer surface 312, and a generally cylindrical inner surface 313. For clarity, the various electrical, hydraulic, and optical connections are removed, but would generally be located within the cylindrical inner surface 313.

The generally cylindrical outer surface 312 of motor head 310 comprises a first cylindrical outer surface 314 extending axially from the first end 310*a* to an outer upward-facing shoulder 319. The first cylindrical outer surface 314 includes a first elongate annular indentation 314*a* disposed proximate motor head first end 310*a* and a second elongate annular indentation 314*b* disposed approximately midway between motor head first end 310*a* and shoulder 319. A second cylindrical outer surface 320 extends axially from the shoulder 319 to a third indentation 321; the third indentation is configured to receive a retention member 339. The retention member 339 may be any type of retention member known in the art including, but not limited to, a snap ring. A third cylindrical outer surface 322 extends axially from the third indentation 321 to the motor head second end 310*b*. The third cylindrical outer surface 322 includes a groove 322*a* configured to receive a seal. The seal may be any type of seal known in the art including, but not limited to an O-ring, O-seal, T-seal with back up rings, polymeric spring energized lip seals, metallic lip seals, and C-rings.

The generally cylindrical inner surface 313 of motor head 310 comprises a first cylindrical inner surface 325 extending axially from the first end 310*a* to a first upward-facing shoulder 326. A second cylindrical inner surface 328 having a reduced diameter extends from the first shoulder 326 to a second upward-facing shoulder 329. A third cylindrical inner surface 330 having a reduced diameter extends from the second shoulder 329 to the motor head second end 310*b*. In the present embodiment, the first cylindrical inner surface 325 has three axial cutouts or slots 325*a*; in other embodiments, surface 325 may have as few as one cutout or slot, or four or more cutouts or slots.

Figure 12:
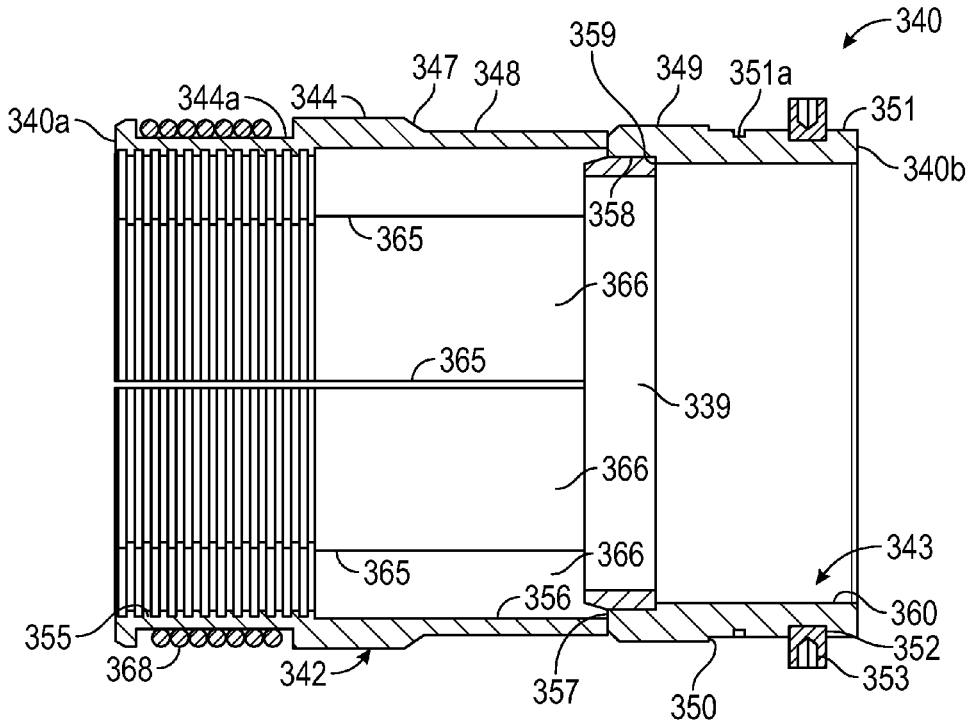
FIG. 12 is a cross-sectional side view of the release nut of the release system of FIG. 2.

Referring now to FIGS. 2, 3, and 12, the release nut 340 is tubular and has a first or upper end 340*a* opposite a second or lower end 340*b*, a generally cylindrical outer surface 342, and a generally cylindrical inner surface 343. The generally cylindrical outer surface 342 of the release nut 340 comprises a first cylindrical outer surface 344 extending axially from the first end 340*a* to an outer angular shoulder 347 that extends axially toward release nut second end 340*b* and radially inward to a second cylindrical outer surface 348. The first cylindrical outer surface 344 includes an elongate annular indentation or recess 344*a* disposed proximate release nut first end 340*a*. The recess 344*a* is configured to receive and retain a biasing member 368. The biasing member may be any biasing member known in the art including, but not limited to, a close coiled spring, a plurality of wrap springs, or a plurality of single circlips. The second cylindrical outer surface 348 extends axially to a third cylindrical outer surface 349 having a slightly larger diameter. A fourth cylindrical outer surface 351 extends axially from a downward-facing shoulder 350 to the release nut second end 340*b*. The fourth cylindrical outer surface 351 includes a groove 351*a* disposed proximate shoulder 350 configured to receive a seal. The seal may be any type of seal known in the art including, but not limited to an O-ring, O-seal, T-seal with back up rings, polymeric spring energized lip seals, metallic lip seals, and C-rings. The fourth cylindrical outer surface 351 further includes a plurality of threaded radial bores 352 spaced circumferentially about the central axis 105 proximate the release nut second end 340*b*.

The generally cylindrical inner surface 343 of release nut 340 comprises a threaded portion 355 that extends axially from the release nut first end 340*a* to a first inner cylindrical surface 356. The first inner cylindrical surface 356 extends axially to a first upward-facing shoulder 357. A second cylindrical surface 358 extends axially from first shoulder 357 to a second upward-facing shoulder 359. A third inner cylindrical surface 360 extends axially from the second upward-facing shoulder 359 to the release nut second end 340*a*. The second cylindrical surface 358 and second upward-facing shoulder 359 are configured to engage the retention member 339.

The release nut further comprises a plurality of slots 365 that extend axially from the release nut first end 340*a* to the first shoulder 357, and extend radially from outer surface 342 through to inner surface 343, forming a plurality of fingers 366. The slots allow the fingers 366 to slightly flex radially. Thus, the release nut 340 may also be referred to as a slotted release nut 340. In the present embodiment, there are eight slots 365 and eight fingers 366 (not all slots 365 are shown). In other embodiments, there may be as few as two slots 365 and two fingers 366, or there may be more than eight slots 365 and eight fingers 366.

Figure 13:
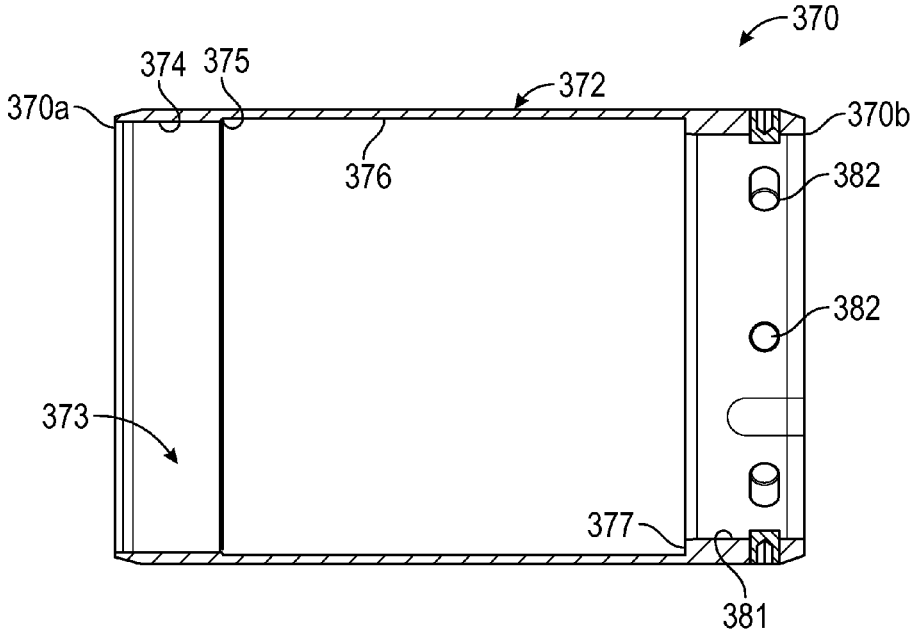
FIG. 13 is a cross-sectional side view of the protection sleeve of the release system of FIG. 2.

Referring now to FIGS. 2, 3, and 13, the protection sleeve 370 is tubular and comprises a first or upper end 370*a* opposite a second or lower end 370*b*, a cylindrical outer surface 372, and a generally cylindrical inner surface 373. The generally cylindrical inner surface 373 of the protection sleeve 370 comprises a first cylindrical inner surface 374 extending axially from the first end 370*a* to a downward-facing shoulder 375. A second cylindrical inner surface 376 extends axially from the downward-facing shoulder 375 to an upward-facing shoulder 377; and a third cylindrical inner surface 381 extends from the upward-facing shoulder 377 to protection sleeve second end 370*b*. The third cylindrical inner surface 381 has a plurality of through bores 382 spaced circumferentially about the central axis 105 proximate the sleeve second end 370*b*. In the present embodiment, the third cylindrical inner surface 381 has eight through bores 382. In other embodiments, the third cylindrical surface 381 may comprise three or more through bores 382.

The tool connection release system 100 when deployed with a service tool in a high pressure environment and before activation of the release system 100, as shown in FIG. 2, includes the plug connector 210 coupled to the actuation cylinder housing 230. The plurality of threaded bores 250 spaced circumferentially about the central axis 105 of the actuation housing first end 230*a* are configured to align with the plurality of circumferentially spaced through holes 223*a* of the flange 223 portion of the plug connector 210. The threaded bores 250 are further configured to threadably couple to fasteners or bolts 251 to secure the flange 223 of the plug connector 210 to the first end 230*a* of the actuation housing 230. When the plug connector 210 is fastened to the housing 230, the plug connector third cylindrical outer surface 224 is disposed adjacent a portion of the housing first cylindrical surface 234 proximate the housing first end 230*a*. Seals are disposed in grooves 224*a* to seal between the plug connector third cylindrical outer surface 224 and the housing first cylindrical surface 234. A seal is disposed in groove 226*b* to seal between the plug connector fourth cylindrical outer surface 226 and the motor head second cylindrical inner surface 328.

Referring now to FIGS. 2 and 3, a first annular space or cavity 385, shown in FIG. 3, is formed between the first cylindrical surface 234 and second inner cylindrical surface 236 of the housing 230 and the fourth cylindrical outer surface 226 and fifth cylindrical outer surface 228 of the plug connector 210; the first cavity 385 extends axially from the first downward-facing shoulder 225 to the second end 210*b* of the plug connector 210.

Referring now to FIG. 2, the piston cap 280 is configured to threadably engage the housing 230 such that the threaded portion 240 of the housing 230 engages the threaded portion 284 of the piston cap 280, and housing second end 230*b* is adjacent the upward-facing shoulder 285 of the piston cap. In an alternative embodiment, the piston cap 280 may be welded to housing 230 proximate upward-facing shoulder 285 using any welding method known in the art including, but not limited to, electron beam, laser, or T.I.G.; in this alternative embodiment, other methods of sealing may also be applied. The annular piston cap 280 is radially disposed between a portion of the actuation cylinder housing 230, a portion of the protection sleeve 370, and the annular piston 260. As the piston cap 280 is threadably coupled to the housing 230 and the housing is coupled to the plug connector 210 with bolts 251, the first and second protrusions 264*a*, 264*b*, respectively, of the piston 260 are retained by the annular piston cap first end 280*a* to prevent the piston 260 from separating from the housing 230 and plug connector 210.

Referring still to FIG. 2, the annular piston 260 is radially disposed between the housing 230 and the motor head 310. More specifically, the piston 260 is disposed in the actuation housing 230 such that the first and second annular protrusions or rings 264*a*, 264*b*, respectively, of the piston 260 slidingly engage the housing third cylindrical surface 238. A seal 281 is disposed in groove 288*a* of the first cylindrical surface 288 of the piston cap 280, and sealingly engages the first cylindrical surface 264 of the piston 260.

A second annular space or cavity 386 is formed radially between the housing third cylindrical surface 238 and the piston first cylindrical surface 264 and axially between the housing second downward-facing shoulder 237 and the first annular protrusion 264*a*. The second cavity 386 is in fluid communication with the second elongate channel 244 in the housing 230. The axial movement of the piston 260 is restricted in one direction by the housing second downward-facing shoulder 237 along with the housing first downward-facing shoulder 235, and bound in the opposite direction by the annular piston cap first end 280*a* and the motor head outer upward-facing shoulder 319.

A seal is disposed between the first and second annular protrusions 264*a*, 264*b*, respectively, to sealingly engage the housing third cylindrical surface 238. A seal is also disposed in the groove 236*a* of the housing second cylindrical surface 236 about the piston first cylindrical surface 264.

A third annular space or cavity 387 is formed radially between the piston cap cylindrical surface 287 and the piston first cylindrical surface 264 and axially between the piston cap downward-facing shoulder 289 and the piston cap second end 280*b*.

Referring still to FIG. 2, the motor head 310 is disposed in the annular piston 260 such that the motor head first cylindrical outer surface 314 slidingly engages the piston cylindrical inner surface 263, and piston second end 260*b* is disposed adjacent the motor head outer upward-facing shoulder 319.

The motor head 310 is disposed radially within the actuation cylindrical housing 230, such that the motor head first end 310*a* is disposed adjacent the plug connector first downward-facing shoulder 225. In addition, the three axial cutouts or slots 325*a* spaced about the first cylindrical inner surface 325 of the motor head 310 are configured to align with the three keys 226*a* disposed on the fourth cylindrical outer surface 226 of the plug connector 210. The motor head 310 and the plug connector 210 remain in alignment during connections or disconnections across the axial length of the keys 226*a*, which helps reduce possible damage to the tool connectors housed in the plug connector 210 by controlling the alignment during engagement and separation. In the present embodiment, the location of the keys 226*a* and corresponding slots 325*a* allow connection of the motor head 310 to the plug connector 210 in a single orientation; however, in other embodiments, different keying configurations may be used that employ more or less keys and corresponding slots with locations that may allow connection of the motor head to the plug connector in more than one orientation.

Referring still to FIG. 2, the motor head 310 is disposed in the annular piston 260 such that the motor head first cylindrical outer surface 314 slidingly engages the piston cylindrical inner surface 263, and piston second end 260*b* is disposed adjacent the motor head outer upward-facing shoulder 319.

Referring now to FIGS. 2, 11, and 12, the slotted release nut 340 is radially disposed between the motor head 310, a portion of the piston 260, and the protection sleeve 370. A seal is disposed in groove 322*a* of the third cylindrical outer surface 322 of the motor head 310, and sealingly engages the third inner cylindrical surface 360 of the slotted release nut 340. The retention member 339 disposed in motor head indentation 321 extends radially outward past the motor head third cylindrical outer surface 322 to engage the second cylindrical surface 358 and the second upward-facing shoulder 359 of the release nut 340. Retention member 339 restricts the axial movement of the release nut 340 toward the plug connector 210.

The slotted release nut 340 is configured to threadably engage the piston 260 such that the threaded portion 355 of the slotted release nut 340 engages the threaded portion 268 of the piston 260, and release nut first end 340*a* is adjacent the second cylindrical surface 266 of the annular piston 260. The biasing member 368 disposed in the recess 344*a* of the release nut 340 is configured to maintain the threaded engagement of the piston 260 to the slotted release nut 340 until a sufficient axial force causes the threads 268 of the piston 260 to slide against the threads 355 of the release nut 340 and force the release nut threads to expand or move radially outward. The outward radial movement of the release nut threads 355 is possible due to the plurality slots 365 and resulting fingers 366 of the release nut 340. In other words, the threads 268 of the piston 260 under a predetermined load will jump the threads 355 of the release nut 340. The predetermined load is typically about 24,000 lbf and is governed by several factors including, but not limited to the design of the slots and resulting fingers (e.g., the width and axial length of the slots), the thread profile of the piston and release nut, and the spring reaction load. In an alternative embodiment, several wrap springs with a fewer number of turns to limit the clutch friction force or multiple single circlips could be used for the biasing member 368.

A fourth annular space or cavity 388 is formed radially between the second cylindrical outer surface 320 of the motor head 310 and the first inner cylindrical surface 356 of the release nut 340, and axially between the release nut threaded portion 355 and the first upward-facing shoulder 357 of the release nut 340.

Referring now to FIGS. 2 and 13, the protection sleeve 370 is radially disposed about a portion of the annular piston cap 280 and the slotted release nut 340. Fasteners or bolts 353 are configured to threadably couple the protection sleeve 370 to the slotted release nut 340 by passing through the sleeve through bores 382 and engaging the threaded bores 352 of the slotted release nut 340.

The plurality of threaded bores 352 spaced circumferentially about the central axis 105 of the fourth cylindrical outer surface 351 of the release nut 340 are configured to align with the plurality of circumferentially spaced through holes 382 of the sleeve 370. The threaded bores 352 are further configured to threadably couple to the fasteners or bolts 353 to secure the sleeve 370 to the release nut 340.

A seal is disposed in groove 351*a* on the release nut fourth cylindrical outer surface 351 to sealingly engage the third cylindrical inner surface 381 of the protection sleeve 370. A seal is also disposed in the groove 322*a* on the motor head third cylindrical outer surface 322 to sealingly engage the third inner cylindrical surface 360 of the release nut 340.

A fifth annular space or cavity 389 is formed radially between the second cylindrical surface 266 of the piston 260 and the second cylindrical inner surface 376 of the sleeve 370, and axially between the piston cap second end 280*b* and the release nut first end 340*a*. A sixth annular space or cavity 390 is formed radially between the generally cylindrical outer surface 342 of the release nut 340 and the generally cylindrical inner surface 373 of the sleeve 370. The third, fifth, and sixth cavities 387, 389, 390, respectively, are in fluid communication with one another.

Figure 14:
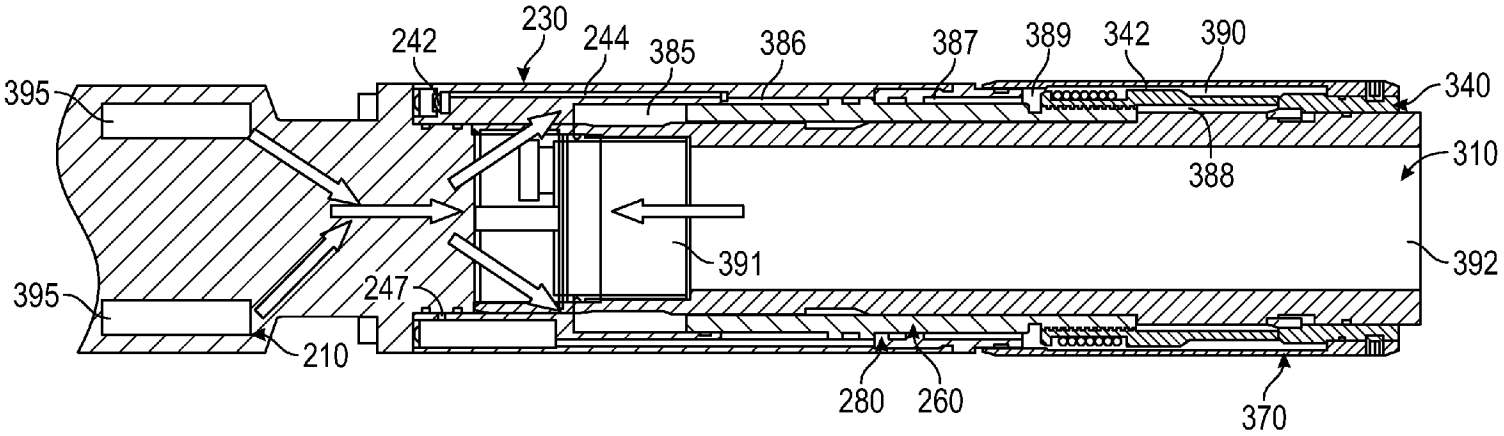
FIG. 14 is a cross-sectional side view of the release system of FIG. 2 in a connected state.
Figure 15:
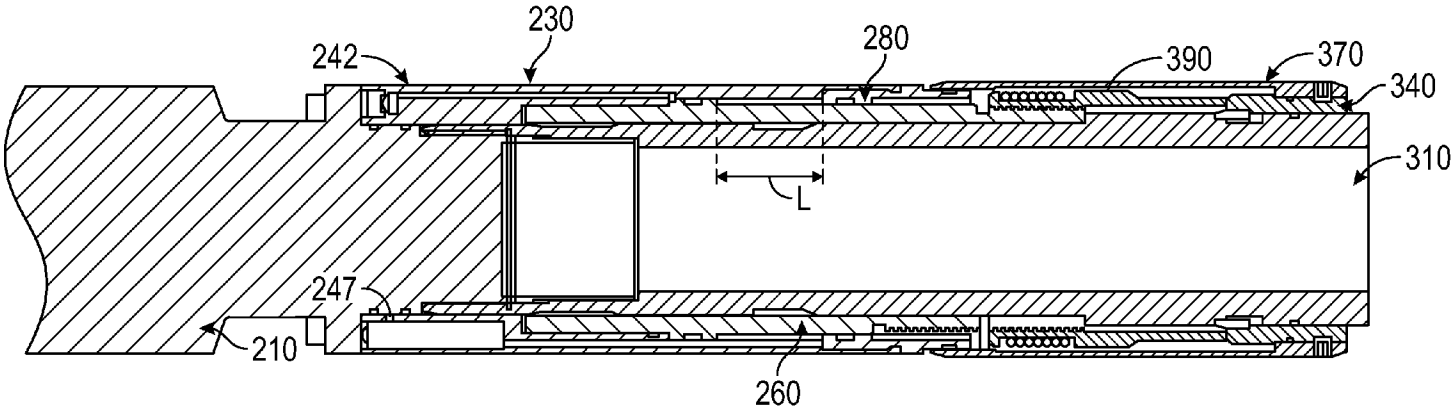
FIG. 15 is a cross-sectional side view of the release system of FIG. 2 in a disconnected state.

Referring now to FIGS. 14 and 15, the annular spaces or cavities 385-390 are pressure balanced to resist external pressure and facilitate movement and disconnection of the upper end 200 and lower end 300 of the connection release system 100. The annular spaces or cavities 385-390 are pressure compensated by means of a pressure compensation system in the plug connector 210, which has an oil reservoir 395 and bellows system incorporated therein (not shown). The cavities 385-390 are filled via check valves with oil prior to attaching the plug connector 210 at flange 223. To balance the pressure between the release system 100 upper end 200 and lower end 300, motor oil is fed via check valves (not shown) to a cavity 391 from a motor cavity 392. The seals disposed in groove 226*b* (FIGS. 2 and 4) and groove 287*a* (FIG. 10) allow the upper and lower ends 200, 300, respectively, to separate under high pressure, typically 9,000 to 24,000 psi. By filling the cavities 385-390 with oil, the piston 260 and the release nut 340 are fully enclosed and sealed to exclude sand, silt, and debris, which could cause sticking or jamming and hinder the movement or separation of the upper and lower ends 200, 300, respectively.

Referring now to FIGS. 6 and 7, before activation, the first fluid chamber 248 is filled with hydraulic fluid from the control line or hydraulic fluid source (not shown) and the second fluid chamber 258 is filled with hydraulic fluid. The fluid in the first fluid chamber 248 is connected to fluid source (not shown) and separated from the fluid in the second fluid chamber 258 by the piston 260. In particular, the hydraulic fluid in the first fluid chamber 248 acts on the piston 260 at the second protrusion 264*b* (FIGS. 9 and 2), whereas the fluid in the second fluid chamber 258 acts oppositely on the piston at the first protrusion 264*a* such that the piston 260 is pressure-balanced. Thus, the fluid in the first fluid chamber 248 and the fluid in the second fluid chamber 258 act in opposite directions on the piston 260 to keep the piston 260 pressure-balanced. The sealed opening or burst disc 246 in housing 230 acts as a barrier to keep the hydraulic fluid in the second channel 244 out of the second chamber 242, the plurality of connecting galleries 257, and the plurality of overflow cavities 255. The cavities 255 also provide structural strength for the annular piston 260 to resist the collapse pressure from the external environment, which is approximately 24,000 psi. The volume of the cavities 255 is configured to receive the displacement volume of the fluid from the piston 260 to stroke through its actuation length L (FIG. 15) upon actuation of the release system 100. Thus, overflow cavities 255 may also be referred to as buffer cavities or buffer chambers.

To actuate the release system 100, hydraulic fluid is pressurized in the control line (not shown) and fed through inlet port 247 and added to the fluid already in the housing first cylindrical chamber 241 and the housing first elongate channel 243, which is in fluid communication with the graduated downward-facing shoulder 239 and face 264*c* of the second annular piston protrusion 264*b*. The additional pressurized fluid acts on the second protrusion 264*b* of the piston 260 to move the annular piston 260 axially toward the plug connector 210 while the first annular protrusion 264*a* transfers pressure along second elongate channel 244 to the burst disc 246. The burst disc 246 is isolated from the pressure compensation fluid and, therefore, independent of the external pressure around the tool or motor. The burst disc is configured to rupture under a desired or predetermined pressure, for example, between 6,000-15,000 psi; factors that impact the rupture pressure include, but are not limited to, the application and the disc rating. As the piston 260 moves axially toward the plug connector 210 and the burst disk 246 ruptures, the hydraulic fluid flows into the second chamber 242 and into the cavities 255 through the connecting galleries 257. While the piston 260 moves axially toward the plug connector 210, the slotted release nut fingers 366 also move radially outward to allow the piston threads 268 to disengage the slotted release nut threads 355. As the piston threads 268 disengage the slotted release nut threads 355, a hydraulic signature is created that can be used to assess the success of the disconnection as the pressure will build and then fall when each thread disengages. Once the final thread is cleared, as shown in FIG. 15, the plug connector 210 can be separated from the motor head 310 by pulling the cable or coiled tubing 150 (FIG. 1).

If the hydraulic line is not functioning for any reason, leakage or damage for example, a secondary release method without the use of a pressurized fluid is available by manually pulling on the cable or coiled tubing 150 to disengage the piston threads 268 from the slotted release nut threads 355, which is configured to release at a predetermined load, for example, approximately 24,000 lb.

While various embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order, and disclosed features and components can be arranged in any suitable combination to achieve desired results.

What is claimed is:

1. A tool connection release system, the system comprising:

a housing having a first portion and a second portion;

a piston disposed at least partially within the housing first portion and at least partially within the housing second portion;

a first fluid chamber including a first pressurized fluid acting against the piston;

a fluid source coupled to the first fluid chamber;

a sealed opening configured to rupture and open under a predetermined pressure; and a second fluid chamber, in fluid communication with the sealed opening, including a second pressurized fluid acting against the piston to oppose the first pressurized fluid and pressure-balance the piston;

wherein addition of a fluid from the fluid source to the first fluid chamber causes the piston to move and the first housing portion to separate from the second housing portion.

2. The system of claim 1, further comprising a piston shoulder separating the first and second fluid chambers, and wherein the first pressurized fluid in the first fluid chamber acts on the piston shoulder in a first direction, and the second pressurized fluid in the second fluid chamber acts on the piston shoulder in a second direction opposite the first direction.

3. The system of claim 2, wherein the addition of the pressurized fluid to the first fluid chamber ruptures the sealed opening allowing the fluid to communicate with at least one of a plurality of buffer chambers.

4. The system of claim 3, wherein the fluid flows past the ruptured sealed opening to the plurality of buffer chambers.

5. The system of claim 4, wherein the buffer chambers are configured to receive an amount of the fluid equivalent to a displacement volume of the fluid from a stroke of the piston through an actuation length.

6. The system of claim 5, wherein the first housing portion and the second housing portion are separated by manually pulling on one of the first or second housing portions.

7. A tool connection release system, the system comprising:

a housing having a first portion and a second portion, the first portion being coupled to a cable;

a piston having a first end axially disposed at least partially within the housing first portion, and a plurality of threads at a second end;

a first fluid chamber including a first pressurized fluid acting against the piston;

a fluid source coupled to the first fluid chamber;

a sealed opening configured to rupture and open under a predetermined pressure; and a second fluid chamber, in fluid communication with the sealed opening, including a second pressurized fluid acting against the piston to oppose the first pressurized fluid and pressure-balance the piston; and a release nut disposed within the housing second portion and having a plurality of threads at an interior portion of a first end, a recess at an exterior portion of the first end, a second end, and a plurality of circumferentially disposed slots that pass through the plurality of threads and the recess in the first end, the second end being attached to a portion of the housing second end;

wherein the threaded exterior portion of the piston is configured to releasably engage the threaded interior portion of the release nut and the plurality of circumferentially disposed slots is configured to allow the release nut first end to move radially outward and disengage the threaded exterior portion of the piston from the threaded interior portion of the release nut such that the piston and the housing first portion are separable from the release nut and the housing second portion.

8. The tool connection release system of claim 7, wherein a plurality of cavities are formed between the housing first and second portions and the piston, and between the housing second portion and the release nut, the plurality of cavities being in fluid communication with one another.

9. The tool connection release system of claim 8, the housing first portion further comprises at least one bore having a burst disc disposed therein.

10. The tool connection release system of claim 9, wherein the plurality of cavities is filled with fluid, providing a sealed environment for the piston and the release nut.

11. The tool connection release system of claim 10, the housing first portion further comprising:

a first fluid chamber disposed in the first housing portion, connected to a fluid source, and in fluid communication with a first portion of the piston; and a second fluid chamber disposed in the first housing portion and in fluid communication with a second portion of the piston;

wherein the first and second fluid chambers are separated by the piston and configured to receive fluid;

wherein when the first fluid chamber and second fluid chamber are filled with fluid, the fluid in the first fluid chamber acts on the piston in a first direction and the fluid in the second chamber acts on the piston in a second direction opposite the first direction to pressure-balance the piston.

12. The tool connection release system of claim 11, wherein additional fluid is added to the fluid-filled first fluid chamber to displace the fluid and move the piston, such that fluid flows to the burst disc, actuates the burst disc, and flows into a gallery beyond the burst disc;

the movement of the piston thereby causing the threaded exterior portion of the piston to disengage the threaded interior portion of the release nut.

13. The tool connection release system of claim 12, wherein a hydraulic signature is created as each thread of the threaded exterior portion of the piston disengages each thread of the threaded interior portion of the release nut.

14. The tool connection release system of claim 13, further comprising a biasing element disposed in the recess at the exterior portion of the release nut first end.

15. The tool connection release system of claim 14, wherein a force exerted to separate the piston and the housing first portion from the release nut and the housing second portion overcomes the biasing element.

16. The tool connection release system of claim 15, wherein the force exerted to overcome the biasing element is supplied by the additional fluid.

17. The tool connection release system of claim 15, wherein the force exerted to overcome the biasing element is supplied by an external force exerted on the cable and transmitted to the housing first portion and the piston.

18. A tool connection release system, the system comprising:

a plug connector having a first end and a second end, the first end coupled to a cable, and an outer portion of the second end having at least one axial protrusion;

an actuation cylinder housing having a first end, a second end, and a plurality of circumferentially spaced galleries, the first end coupled to the plug connector;

a piston having a first end, a second end, and a plurality of threads at an exterior portion of the second end, the piston being axially disposed at least partially within the activation cylinder housing and forming a first cavity therein;

a piston cap is disposed around the piston and forms a second cavity therein, threadably engages the second end of the actuation cylinder, and is configured to retain the first end of the piston within the actuation cylinder;

a motor head having a first end and a second end, an inner portion of the first end having at least one axial recess configured to engage the protrusion on the outer portion of the plug connector second end;

a release nut having a plurality of threads at an interior portion of a first end, a recess at an exterior portion of the first end, a second end, and a biasing member disposed in the recess; and a protection sleeve disposed about the release nut and a portion of the piston cap, the sleeve forming a third cavity with the release nut;

wherein the piston is configured to axially slide around an outer portion of the motor head;

wherein the plurality of threads on the exterior portion of the piston second end is configured to releasably engage the threads on the interior portion of the release nut first end upon addition of a pressurized fluid.

19. The system of claim 18, wherein the first, second, and third cavities are filled with fluid and pressure-balanced.

20. The system of claim 19, wherein the addition of the pressurized fluid ruptures a burst disc allowing fluid to communicate with the plurality of galleries.

21. The system of claim 20, wherein the housing first end and the housing second end are separated by manually pulling on one of the first or second housing ends.

* * * * *